US009303868B2

(12) United States Patent
Smit

(10) Patent No.: US 9,303,868 B2
(45) Date of Patent: Apr. 5, 2016

(54) BURNER SYSTEM HAVING PREMIXED BURNERS AND FLAME TRANSFER MEANS

(75) Inventor: Arendt Jan Smit, En Muntendam (NL)

(73) Assignee: 3FORCE B.V., Muntendam (NL)

( * ) Notice: Subject to any disclaimer, the term of this patent is extended or adjusted under 35 U.S.C. 154(b) by 740 days.

(21) Appl. No.: 12/600,456

(22) PCT Filed: May 14, 2008

(86) PCT No.: PCT/NL2008/000128
§ 371 (c)(1),
(2), (4) Date: Aug. 4, 2010

(87) PCT Pub. No.: WO2008/140301
PCT Pub. Date: Nov. 20, 2008

(65) Prior Publication Data

US 2010/0291501 A1 Nov. 18, 2010

(30) Foreign Application Priority Data

May 15, 2007 (NL) ..... 1033850

(51) Int. Cl.

| | |
|---|---|
| ***F23D 14/64*** | (2006.01) |
| ***F23Q 3/00*** | (2006.01) |
| ***F24B 9/00*** | (2006.01) |
| ***F23D 14/04*** | (2006.01) |
| ***F23Q 9/04*** | (2006.01) |

(52) U.S. Cl.
CPC ..... *F23D 14/045* (2013.01); *F23Q 9/045* (2013.01)

(58) Field of Classification Search
CPC ..... F23D 14/045; F23Q 9/045
USPC ..... 431/354, 264; 90/403; 126/357.1
See application file for complete search history.

(56) References Cited

U.S. PATENT DOCUMENTS

| | | | | |
|---|---|---|---|---|
| 2,875,820 | A * | 3/1959 | Nesbitt | 431/193 |
| 3,092,169 | A * | 6/1963 | Lohman | 431/191 |
| 5,741,129 | A * | 4/1998 | Li | 431/264 |
| 6,152,022 | A * | 11/2000 | Savage et al. | 99/403 |
| 2007/0089732 | A1 | 4/2007 | Ricord | |

(Continued)

FOREIGN PATENT DOCUMENTS

| | | |
|---|---|---|
| DE | 4213197 A1 | 4/1993 |
| GB | 1105159 A | 3/1968 |

OTHER PUBLICATIONS

PCT Patent Application No. PCT/NL2008/000128 filed May 14, 2008 in the name of Smit, International Search Report and Written Opinion mailed Sep. 11, 2008.

* cited by examiner

*Primary Examiner* — William G Corboy
(74) *Attorney, Agent, or Firm* — Levine Bagade Han LLP

(57) ABSTRACT

The invention relates to a burner system having a number of premixed burners (2), which each have one or more feed openings and outflow openings for a combustible gas/air mixture. The burner system is provided with means (11) for transferring a flame from one burner to another. By making use of such flame transfer means the burner system can be ignited at one of the burners, wherein the flame then overflows sufficiently-rapidly to the other burners in order to ignite them before a dangerously large quantity of the combustible gas/air mixture has flown out. These flame transfer means can define a flame path between the burners which can for instance be formed by an overflow pipe (12) mutually connecting the burners. The burner system can further be provided with a member (13) directed toward the flame path for the purpose of injecting the combustible gas/air mixture (M) therein. This injection member can be connected via a branch conduit (14) to a mixing chamber (5) in which the gas/air mixture is formed.

6 Claims, 3 Drawing Sheets

BURNER SYSTEM HAVING PREMIXED BURNERS AND FLAME TRANSFER MEANS

Figure 1:
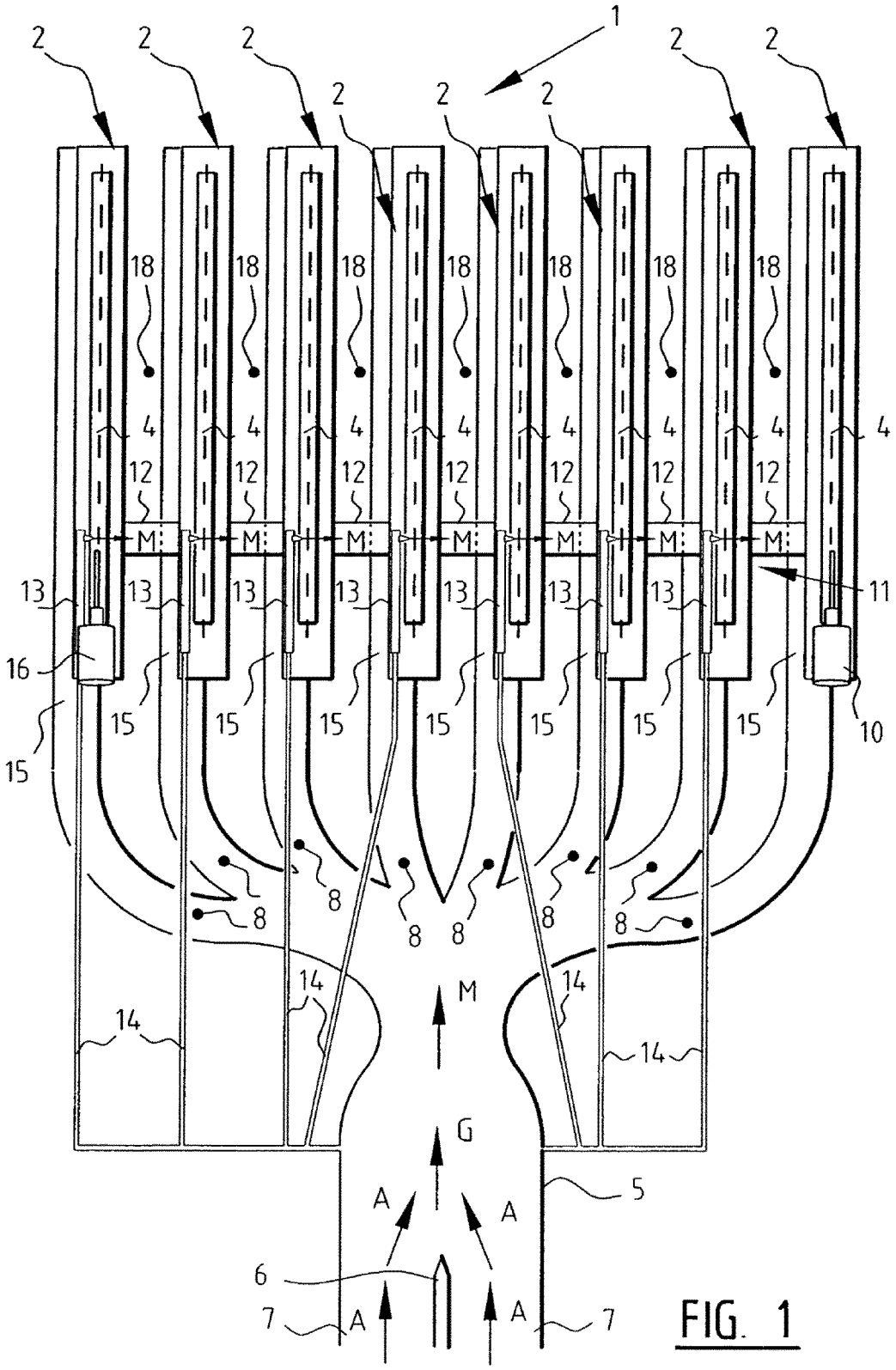

The invention relates to a burner system having at least two premixed burners, wherein each burner has at least one feed opening and at least one outflow opening for a combustible gas/air mixture. Such a burner system is known.

A premixed burner, also referred to as a premix burner, is understood to mean a burner wherein the mixing of gas and a quantity of air necessary for the complete combustion thereof takes place prior to or in the burner head. This premixing can for instance be realized with a venturi system or with a mechanical system with fans. The thus formed combustible gas/air mixture, which often even comprises a slight excess (up to for instance 25%) of air, is then ignited as it leaves the outflow opening.

When several of such premixed burners are disposed adjacently of each other in order to thus form a burner system or burner bed, it is of great importance in the igniting of this burner bed that all burners are ignited simultaneously. If specific burners were to be ignited later, too much combustible gas/air mixture would otherwise have flown out already, which would then combust explosively when ignited.

A burner bed is in practice usually ignited at a central location, after which the flame is then supposed to spread to or overflow onto the adjacent burners from the ignited burner. In order to ignite all burners as far as possible simultaneously, it is therefore important that the overflowing of the flame takes place rapidly.

A problem here is that the outflowing gas/air mixture, when it is not ignited at the burner, mixes directly with the ambient air that is present and thereby becomes incombustible. The overflow of the flame is hereby made considerably more difficult.

The invention now has for its object to provide a burner system with fully premixed burners, wherein this problem does not occur, or at least does so to lesser extent. According to the invention this is achieved in a burner system as described in the preamble by means for transferring a flame from one burner to another. By making use of such flame transfer means the burner system can be ignited at one of the burners, wherein the flame then overflows sufficiently rapidly to the other burners in order to ignite them before a dangerously large quantity of the combustible gas/air mixture has flown out. A safe ignition of the burner system is thus guaranteed.

For the purpose of guiding the flame during overflow the flame transfer means preferably define at least one flame path between the burners.

When the at least one flame path is formed by an overflow pipe mutually connecting the burners, the flame is safeguarded during overflow against being extinguished as a result of an excess of air.

In order to enhance overflow of the flame from one burner to another, the burner system according to the invention is preferably provided with at least one member directed toward the flame path for the purpose of injecting the combustible gas/air mixture therein. The flame is thus as it were "collected".

When the burner system is provided with a mixing chamber for forming the combustible gas/air mixture, this mixing chamber comprising at least one feed opening for air, at least one feed opening for gas and at least two outflow openings for the combustible gas/air mixture, each connected to one of the burners, the at least one injection member is preferably connected via a branch conduit to the mixing chamber. The injection member is then supplied directly from the mixing chamber and thus receives the gas/air mixture at a higher pressure than prevails behind the burner. Amore rapid overflow of the flame is hereby achieved.

The at least one injection member is preferably adapted here to inject the combustible gas/air mixture into the flame path such that a reliable flame transfer is ensured without overheating of the flame path occurring. Overheating of the flame path could after all result in premature ignition of a gas/air mixture injected therein.

When the burners are placed adjacently of each other with interspaces in the burner system, the overflow pipe can advantageously extend through the interspace. The flame can thus be transferred over relatively large distances. The interspace can herein form part of a duct for a medium to be heated by the burners, so that the burner system can be applied in a heat exchanger.

Figure 2:
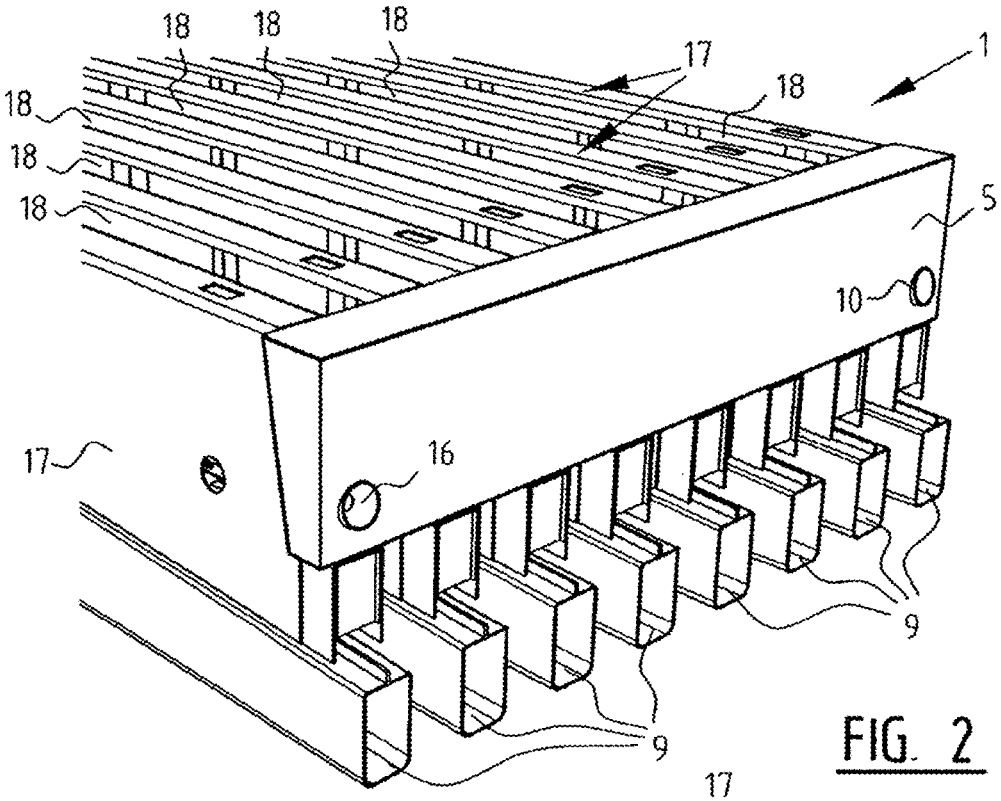
Figure 3:
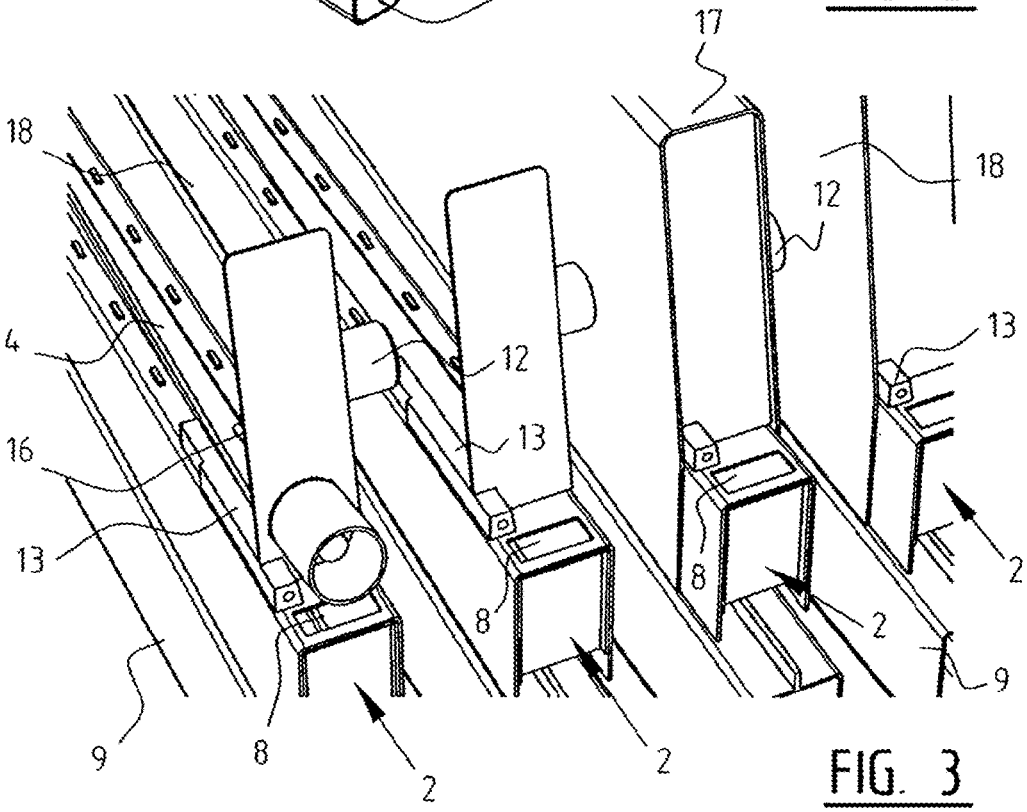
Figure 4:
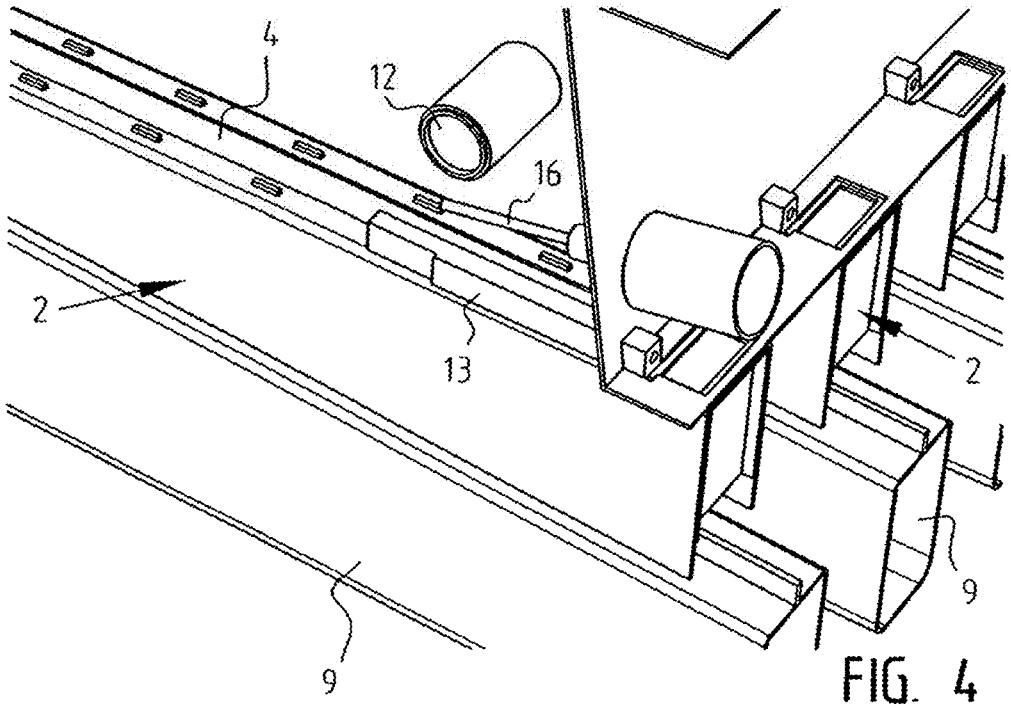
Figure 5:
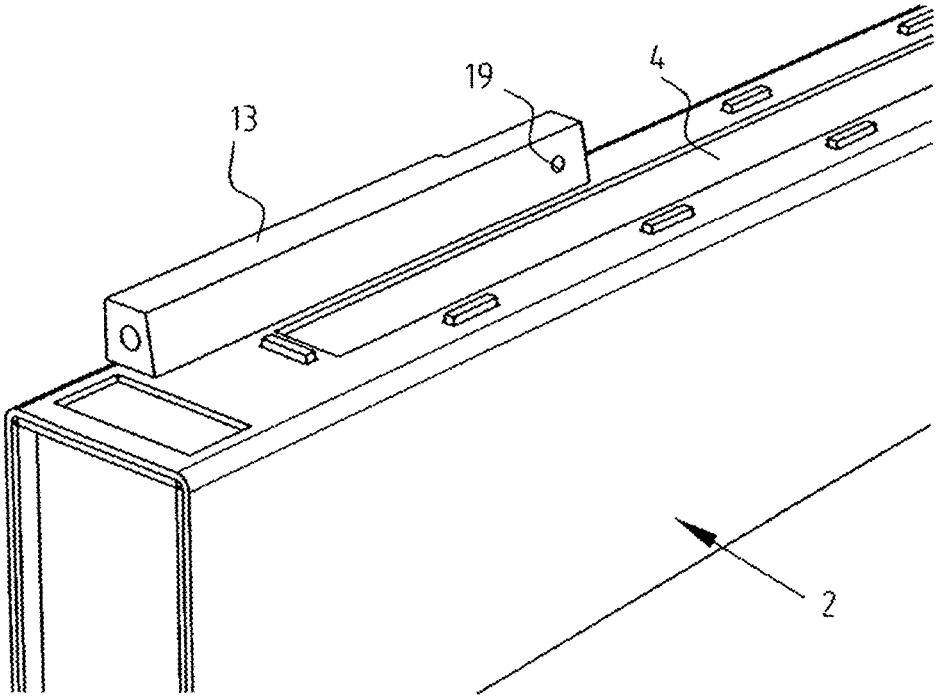

The invention is now elucidated on the basis of an example wherein reference is made to the accompanying drawing, in which:

FIG. 1 is a schematic representation of a burner system according to the invention, FIG. 2 is a perspective front view of a practical application of the burner system in a heat exchanger, FIGS. 3 and 4 are partially cut-away perspective detail views of the burner system of FIG. 2, and FIG. 5 is a perspective detail view of a single burner of the system of FIG. 2-4.

A burner system 1 is provided with at least two, and in the shown example even eight, premixed burners 2 placed upright adjacently of each other. Each burner 2, which tapers in longitudinal direction and thus has a decreasing height, is provided with a feed opening 8 and has on the top side a slot-like outflow opening 4 for a combustible gas/air mixture M. This gas/air mixture M is fed to each burner 2 by a distribution chamber 5 which is provided on its underside with one or more openings. Flue gas discharge pipes 9 are placed beneath burners 2.

The gas/air mixture M is formed in a fan (not shown) and then passes to a mixing chamber or distribution chamber 5 in which gas G is injected through a gas feed opening 6, while air A is drawn in through an air feed opening 7. This suctioning takes place by means of the fan. Distribution chamber 5 is connected to the different burners 2 and has for this purpose a number of outflow openings 8 corresponding to the number of burners 2. These outflow openings 8 are formed in distribution chamber 5 at the outflow end thereof.

Burner system 1 is ignited from a central location. In the shown example the first burner 2 (shown on the right in the drawing) is provided for this purpose with an ignition mechanism 10. In the shown example this is a per se known electric ignition pin arranged directly above outflow opening 4. In order to ignite all other burners 2 at substantially the same time, burner system 1 is provided according to the invention with means 11 for transferring from the one burner 2 to another of the flame formed after ignition of first burner 2. These flame transfer means 11 define in each case a flame path between two adjacent burners 2. In the shown example these flame paths are formed by a set of overflow pipes 12 mutually connecting the burners 2. These overflow pipes 12 are dimensioned such that they provide sufficient space to allow the flame to spread from one burner 2 to another.

Flame transfer means 11 further comprise a number of members 13 directed toward overflow pipes 12 for the purpose of injecting the combustible gas/air mixture M therein. These injection members 13 are each connected via a branch conduit 14 to distribution chamber 5 and have a nozzle 19 directed toward the relevant overflow pipe 12. In the shown example the injection members 13 are adapted in each case to inject the combustible gas/air mixture M into overflow pipe 12 such that a reliable flame transfer is ensured while overheating of overflow pipe 12 is avoided. For this purpose each member 13 injects a quantity of gas/air mixture M which is sufficient to obtain a good in-depth effect, whereby the flame is transferred in reliable manner to the following burner 2. The injected quantity is on the other hand so small that the flame is only transferred and complete combustion does not take place in overflow pipe 12. The appropriate quantity and injection pressure can be determined by the skilled person on the basis of tests and/or calculations.

Injection members 13 are otherwise arranged in each case on the burners 2 still to be ignited adjacently of the outflow opening 4 thereof and they inject the gas/air mixture M in the direction of the already ignited burner(s) 2 so that the flame is as it were "collected".

The burner 2 which is furthest removed from ignition mechanism 10, in this case the burner 2 on the left-hand side, is provided with a flame safety mechanism 16. This flame safety mechanism 16 is likewise formed in conventional manner by a pin which is placed directly above outflow opening 4 and in which an ionization current is generated by the flame when burner 2 is ignited. When there is no flame, there is no further ionization current, and the gas feed will be closed.

Further arranged over the burners 2 are covers 17, thereby forming heating elements closed off from the environment. Thus formed between these heating elements are ducts 18 through which can flow a medium for heating, for instance air. The sides of burner covers 17 herein determine the walls of ducts 18.

The invention thus makes it possible with relatively simple means to ignite a burner system consisting of a number of fully premixed burners in reliable manner from a central point.

Although the invention is described above on the basis of an example, it will be apparent that it is not limited thereto. The number of burners, the form of the burners and their disposition could thus be varied. In addition, the flame transfer means could be embodied otherwise than shown here, for instance with differently formed overflow pipes, or even overflow constructions wholly other than pipes. The form and position of the injection members could also be modified, as could the manner in which these are provided with gas/air mixture. The location from which the burners are ignited and the manner in which this takes place could also be varied. Finally, the burner system according to the invention can be used not only in heat exchanges but also for different applications.

The scope of the invention is therefore defined solely by the following claims.

The invention claimed is:

1. A burner system having at least two fully premixed burners, wherein each burner has at least one feed opening and at least one outflow opening for a combustible gas/air mixture, and a cover above each burner forming a heating element closed off from an environment, wherein at least one of the burners is provided with an electric ignition mechanism arranged directly above the at least one outflow opening, the burner system further comprising:

a flame transfer structure for transferring a flame from one burner to another, wherein said flame transfer structure defines at least one flame path between the cover on each of said burners;

at least one injection member located above said burner within said cover with a nozzle directed toward the flame path for the purpose of injecting the combustible gas/air mixture into the flame transfer structure; and a mixing chamber for forming the combustible gas/air mixture, said mixing chamber comprising at least one feed opening for air, at least one feed opening for gas and at least two outflow openings for the combustible gas/air mixture, each connected to one of the burners, the air and gas feed openings being arranged at an upstream end of the mixing chamber and the outflow openings being arranged at a downstream end of the mixing chamber; and wherein the at least one injection member is connected via a branch conduit to the mixing chamber between the upstream and downstream ends of the mixing chamber.

2. The burner system as claimed in claim 1, wherein a plurality of burners are arranged side-by-side and wherein the ignition mechanism forms part of an outermost burner of said plurality of burners.

3. A burner system comprising at least two fully premixed burners, wherein each bunter has at least one feed opening and at least one outflow opening for a combustible gas/air mixture, and a cover above the burner forming a heating element closed off from an environment, wherein at least one of the burners is provided with an electric ignition mechanism arranged directly above the at least one outflow opening;

a flame transfer structure for transferring a flame from one burner to another;

wherein said flame transfer structure comprises an overflow pipe mutually connecting the covers of each of said burners, where said overflow pipe has a closed wall and defines at least one flame path between the cover of said burners and maintains a ratio of the gas/air mixture by preventing mixing of ambient air with the gas/air mixture;

at least one injection member located above said burner within the cover with a nozzle directed toward the flame path for the purpose of injecting the combustible gas/air mixture into the overflow pipe; and a mixing chamber for forming the combustible gas/air mixture, this mixing chamber comprising at least one feed opening for air, at least one feed opening for gas and at least two outflow openings for the combustible gas/air mixture, each connected to one of the burners, wherein the air and gas feed openings are arranged at an upstream end of the mixing chamber and the outflow openings are arranged at a downstream end of the mixing chamber;

wherein the at least one injection member is connected via a branch conduit to the mixing chamber between the upstream and downstream ends of the mixing chamber.

4. The burner system as claimed in claim 1, wherein the burners are placed adjacently to each other with an interspace, and the overflow pipe extends through the interspace.

5. The burner system as claimed in claim 4, wherein the interspace forms part of a duct for a medium to be heated by the burners.

6. The burner system as claimed in claim 1, wherein the at least one injection member is arranged on an opposite side of the bunter and adapted to inject the combustible gas/air mixture across the at least one outflow opening toward the overflow pipe.

* * * * *